US009078794B2

(12) United States Patent
Shan

(10) Patent No.: US 9,078,794 B2
(45) Date of Patent: Jul. 14, 2015

(54) ELECTRIC BED FRONT MOTOR DRIVE STRUCTURE

(71) Applicant: Huafeng Shan, Jiaxing (CN)

(72) Inventor: Huafeng Shan, Jiaxing (CN)

( * ) Notice: Subject to any disclaimer, the term of this patent is extended or adjusted under 35 U.S.C. 154(b) by 0 days.

(21) Appl. No.: 13/908,168

(22) Filed: Jun. 3, 2013

(65) Prior Publication Data

US 2014/0123391 A1 May 8, 2014

(30) Foreign Application Priority Data

Nov. 6, 2012 (CN) ..... 2012 1 0437918
Nov. 6, 2012 (CN) ..... 2012 2 0579701 U

(51) Int. Cl.

| | |
|---|---|
| ***A61G 7/015*** | (2006.01) |
| ***A61G 7/002*** | (2006.01) |
| ***A61G 7/018*** | (2006.01) |
| *A47C 20/04* | (2006.01) |
| *A61G 7/012* | (2006.01) |

(52) U.S. Cl.

CPC ..... *A61G 7/015* (2013.01); *A61G 7/002* (2013.01); *A61G 7/018* (2013.01); *A47C 20/041* (2013.01); *A61G 7/012* (2013.01); *A61G 2203/42* (2013.01)

(58) Field of Classification Search

CPC ..... A61G 7/012; A61G 7/002; A61G 7/015; A61G 7/018; A61G 2203/42; A47C 20/041
USPC ..... 5/616–618, 613; 310/12.27, 68 B
See application file for complete search history.

(56) References Cited

U.S. PATENT DOCUMENTS

| | | | | |
|---|---|---|---|---|
| 5,537,701 | A * | 7/1996 | Elliott | 5/616 |
| 5,579,550 | A * | 12/1996 | Bathrick et al. | 5/618 |
| 5,608,932 | A * | 3/1997 | Hasegawa | 5/616 |
| 5,870,784 | A * | 2/1999 | Elliott | 5/616 |
| 6,006,379 | A * | 12/1999 | Hensley | 5/616 |
| 6,101,647 | A * | 8/2000 | Stroud et al. | 5/616 |
| 6,216,295 | B1 * | 4/2001 | Pearson | 5/616 |
| 6,363,556 | B1 * | 4/2002 | Krauska et al. | 5/616 |
| 6,393,641 | B1 * | 5/2002 | Hensley | 5/616 |
| 6,826,793 | B2 * | 12/2004 | Tekulve | 5/616 |
| 6,851,144 | B2 * | 2/2005 | Wang | 5/616 |
| 6,990,698 | B2 * | 1/2006 | Wall, Sr. | 5/618 |
| 7,080,439 | B2 * | 7/2006 | Weinman et al. | 29/434 |
| 7,472,442 | B2 * | 1/2009 | Mossbeck | 5/618 |
| 7,484,254 | B2 * | 2/2009 | Eriksson et al. | 5/616 |
| 7,530,125 | B2 * | 5/2009 | Neuenswander | 5/616 |
| 7,900,302 | B2 * | 3/2011 | Long | 5/618 |
| 7,930,780 | B2 * | 4/2011 | Clenet | 5/618 |
| 8,375,488 | B2 * | 2/2013 | Rawls-Meehan | 5/617 |
| 8,484,781 | B2 * | 7/2013 | Kong | 5/616 |
| 2002/0162170 | A1 * | 11/2002 | Dewert | 5/616 |

(Continued)

*Primary Examiner* — Peter M Cuomo
*Assistant Examiner* — Brittany Wilson
(74) *Attorney, Agent, or Firm* — Clement Cheng

(57) ABSTRACT

The invention discloses an electric bed front motor drive structure. The structure of the drive head back bed board is connected to the fixed bed board. The top frame is set beneath the fixed bed board. The upper and lower frame are connected by guiding mechanism and rail movements. The bottom bed-frame has intermediate connecting rods. The intermediate connecting rod has a first bracket. The rotation of the motor bracket lever is hinged at one end of the upper frame between the two side rods. Two connecting rods is set on the rotating rod. Second bracket is located underneath the motor bracket lever. The linear bearing assembly's bottom edge, two sides and two bases are located at the head back portion of the bed board underside. The two linear bearing assemblies connect the bottom edge and two bases.

12 Claims, 4 Drawing Sheets

(56) References Cited

U.S. PATENT DOCUMENTS

| | | | | |
|---|---|---|---|---|
| 2004/0187213 | A1* | 9/2004 | Wang | 5/618 |
| 2010/0325800 | A1* | 12/2010 | Huang | 5/616 |
| 2011/0094032 | A1* | 4/2011 | Shih | 5/616 |
| 2012/0138067 | A1* | 6/2012 | Rawls-Meehan | 5/616 |
| 2012/0186019 | A1* | 7/2012 | Rawls-Meehan | 5/616 |
| 2012/0240337 | A1* | 9/2012 | Shih | 5/616 |
| 2012/0297543 | A1* | 11/2012 | Robertson | 5/616 |
| 2013/0061398 | A1* | 3/2013 | Lim et al. | 5/616 |
| 2013/0145550 | A1* | 6/2013 | Roussy et al. | 5/616 |
| 2014/0000031 | A1* | 1/2014 | Westermann | 5/616 |
| 2014/0009917 | A1* | 1/2014 | Westermann | 5/616 |
| 2014/0035395 | A1* | 2/2014 | Marcantoni | 310/12.27 |
| 2014/0053340 | A1* | 2/2014 | Viberg | 5/657 |

* cited by examiner

ELECTRIC BED FRONT MOTOR DRIVE STRUCTURE

This application is being filed within 12 months of the filing date of its parent application and accordingly claims Paris Convention priority from China patent applications 201220579701.1 and 201210437918.3 both filed Nov. 6, 2012 and both entitled Electric Bed Front Motor Drive Structure by same inventor Shan, Huafeng, the disclosure of which is incorporated herein by reference.

FIELD OF THE INVENTION

The invention relates to an electric bed front motor drive structure.

DISCUSSION OF RELATED ART

With increasing diet and lack of physical exercise, motorized electric beds are becoming more popular in America. The traditional electric bed has a bedboard made of multiple pieces of hinged bedboard such as the headback bedboard, the fixed bedplate, and the leg bedboard and foot bed board. The bedboard has a bottom framework connected to the lower frame and the upper frame. Setting the front and rear motor drives the bedpanels to achieve lift and meet body posture needs. A front bedboard motor drives the movements for supporting the back of the head. The front motor base is hinged on the connecting tube in the middle of the lower frame. The front motor drive rod directly articulates a bracket on an underside of the bed board at the back of the head, bracket and head back bed board screw connection.

The traditional connection structure has some flaws especially when dealing with super obese users. Because the bedboard is mostly wood material having softer characteristics than metal, the bedplate lifting force of the drive rod points are initially highly concentrated in the bed board and the bracket screws are easy to dislodge and bed board damage may occur, which affects the service life of the electric bed. Another traditional electric bed flaw is because of space limitations. The front motor drive head backboard has a shorter lever arm, and its carrying of the motor load makes it easy to damage and also overload the front motor. If using a larger load motor, the production costs of the electric bed are increased as some larger load motors are not mass-produced.

For example, the high initial stress concentration on the wood board to metal bracket connection is seen in Clenet U.S. Pat. No. 7,930,780, issued Apr. 26, 2011 for an Adjustable Bed Frame Assembly and also Hensley United States publication 20010000828 published on May 10, 2001 also for an adjustable bed for an assembly, the disclosures of which are incorporated herein by reference. High initial stress concentration during initial rising from the prone position to the raised position could lead to pulling out of screws, overloading of a motor, or jerky movement for a user on the bed. Electric beds typically have a backboard supporting a head and back, also called a head backboard or a head supporting backboard. The backboard is hinged to a generally horizontal seat section that is also called a seat board. The seat board is hinged to a thigh board that supports the thighs and the thigh-board is hinged to a calf board that supports the calves. The calf board could also be called a footboard since it also supports the feet.

SUMMARY OF THE INVENTION

The present invention aims to solve the above mentioned technical problems to provide an electric bed front motor structure that has improved driving structure, to overcome the traditional electric motor connection structure defects, to avoid damage to the headback bedboard and the front motor, improve electric bed life, and reduce the production costs of the electric bed. In order to solve the above technical problems, the present invention electric bed front motor drive structure includes: a hinge between the back of the head bedboard and the fixed bedboard; the upper frame; lower frame; and the front motor with the drive rod. The upper frame comprises: two side bar; two rails; and four guiding mechanisms. The two side bars are arranged parallel at an interval with two ends bent down.

The two horizontal bars are parallel with each other and also set in between two sidebars. As described, four guide mechanisms are between two sides of the two sidebars. Two horizontal bars are set in the bottom of the fixed bed board. The above upper frame has one end extending to the head back portion 1 bottom. The lower frame includes a rectangular frame, the intermediate connecting rod, and the first bracket and four short rails. The intermediate connecting rod is set inside the rectangular frame. The first bracket is set above the intermediate connecting rod. The four short rail set inside two sides of the rectangular frame. The upper frame has four guide mechanism located within the four short rail of the lower frame. The drive structure further comprises a front motor bracket and the linear bearing assembly.

The motor bracket includes a rotating lever, and two connecting rods and of the second bracket. Rotation of the horizontal lever is hinged to the upper frame at one end of the two sides of the lever between the two connecting rods vertically spaced and disposed on the rotating lever. The second bracket is provided in the bottom surface of the rotating lever.

The linear bearing assembly includes a bottom edge, two side edges, two linear bearings and two bases. The two side edges are separately situated upon two sides of the bottom edge. The two linear bearings has at one end spaced vertically from located at the bottom edge. The two bases are located at the other end of the two linear bearings. The bottom edge, two sides of the bottom edge of the base and two bases are located at the back of the head bottom surface of the bedplate. The front motor bracket has two connecting rods hinged to the two linear bearings.

The motor is mounted to the lower frame intermediate connecting rod at a bracket, the front of the motor drive has hinged attachment to the rotating lever at a second bracket that is welded to the rotating lever.

The front motor bracket has second bracket which is a curved bracket that is curved toward the front motor direction. On the upper frame, the four guide mechanism is a guide wheel or guide slider. The upper frame two crossbars are secured by means of screws located at the fixed bedboard bottom surface. The bottom edge of the linear bearing assembly, the two side edges and the base are connected by screws, respectively provided in a bottom surface of the head back bedboard. The front motor rotating lever of the bracket has a sectional view that is rectangular. A rectangular cross-section of the rotating lever has a good rigidity and improves the torsional properties of the rotating lever to avoid the deformation or distortion of the rotating lever.

The electric bed motor driven structure has a drive structure in the headback bedboard hinged to a fixed bed board. The upper frame is located on the underside of the fixed bed board. The lower frame and the upper frame are connected by guiding mechanisms and rail movements to the lower frame and has an intermediate connecting rod. The intermediate connecting rod is welded to first bracket. The front motor bracket rotating lever is hinged at one end of the upper frame between the two side rods. Two connecting rods at a vertical interval are provided on the rotating lever on the second bracket in the bottom surface of the rotating rod. The linear bearing assembly bottom edge has two sides and two bases located at the headback bed board underside. The two linear bearing assemblies connect the bottom edge and two bases. The front motor bracket has two connecting rods which connect to two linear bearing assemblies. The front motor and the first bracket are connected. The drive lever of the front motor and the second hinge bracket are connected. This drive structure aims to overcome the shortcomings of the traditional electric bed front motor connection structure by decreasing stress and strain on the headback bedboard and the front motor.

Short Summary of the Invention

The invention discloses an electric bed front motor drive structure. The structure of the drive head back bed board is connected to the fixed bed board. The top frame is set beneath the fixed bed board. The upper and lower frame are connected by guiding mechanism and rail movements. The bottom bedframe has intermediate connecting rods. The intermediate connecting rod has a first bracket. The rotation of the motor bracket lever is hinged at one end of the upper frame between the two side rods. Two connecting rods is set on the rotating rod. Second bracket is located underneath the motor bracket lever. The linear bearing assembly's bottom edge, two sides and two bases are located at the head back portion of the bed board underside. The two linear bearing assemblies connect the bottom edge and two bases. The front motor bracket has two connecting rods which connect to two linear bearing assemblies. The front motor and the first bracket are connected. The drive lever of the front motor and the second hinge bracket are connected. This drive structure overcomes the shortcomings of the traditional electric bed front motor connection structure. It avoids damage to the head back portion of the bed board and the front motor, thus improving the life of the electric bed to reduce the production costs of electric bed.

Summary of the Claims

An electric bed front motor drive structure has a head back bedboard in hinged connection to a middle bedboard. The middle bedboard is attached to and supported by an upper frame. The upper frame is attached to and supported by a lower frame. The head back bedboard is configured to hinge upward for raising a head of a user. The lower frame has a pair of connecting rods extending toward the head back bedboard. A linear bearing assembly has edge members attached to linear bearings, and the linear bearing assembly is attached to the head back bedboard. The linear bearing assembly is hinged to the pair of connecting rods in a sliding configuration. A front motor is mounted to the lower frame at a first end of the front motor, and hinge mounted to a front motor frame at a second end of the front motor. The front motor is configured to push up the head back bedboard when the front motor has a drive rod that extends to travel from a retracted position to an extended position. During front motor operation, the head back bedboard has supplemental support from the pair of connecting rods.

The upper frame has two sidebars that have horizontal rods to support the two sidebars. The two sidebars terminate at guiding mechanisms. A total of four diving mechanisms are provided on ends of the two sidebars. The lower frame includes a rectangular frame formed as a periphery of the lower frame. The rectangular frame has an intermediate connecting rod extending horizontally across the rectangular frame. The rectangular frame further includes four short guide rails mounted horizontally on the rectangular frame. The rectangular frame further includes a first bracket for mounting to the front motor first end. The front motor frame further includes a second bracket receiving the second end of the front motor. The front motor frame further includes a second bracket mounted to a rotating lever that is swivel mounted to the front motor frame.

The two connecting rods are welded to the rotating lever. The edge member is attached to linear bearings and additionally optionally includes a bottom edge member having a bottom edge member first end and a bottom edge member second end. The edge member is preferably attached to linear bearings and may also have two side edge members, namely a first edge side member and a second edge side member. The first edge side member is connected to the bottom edge member first end. The second edge side member is connected to the bottom edge member second end. Two bottom base stands are formed on the linear bearing assembly to support the linear bearings.

BRIEF DESCRIPTION OF THE DRAWINGS

The embodiments of the invention are presented further below in conjunction with the accompanying drawings and the detailed description.

Figure 1:
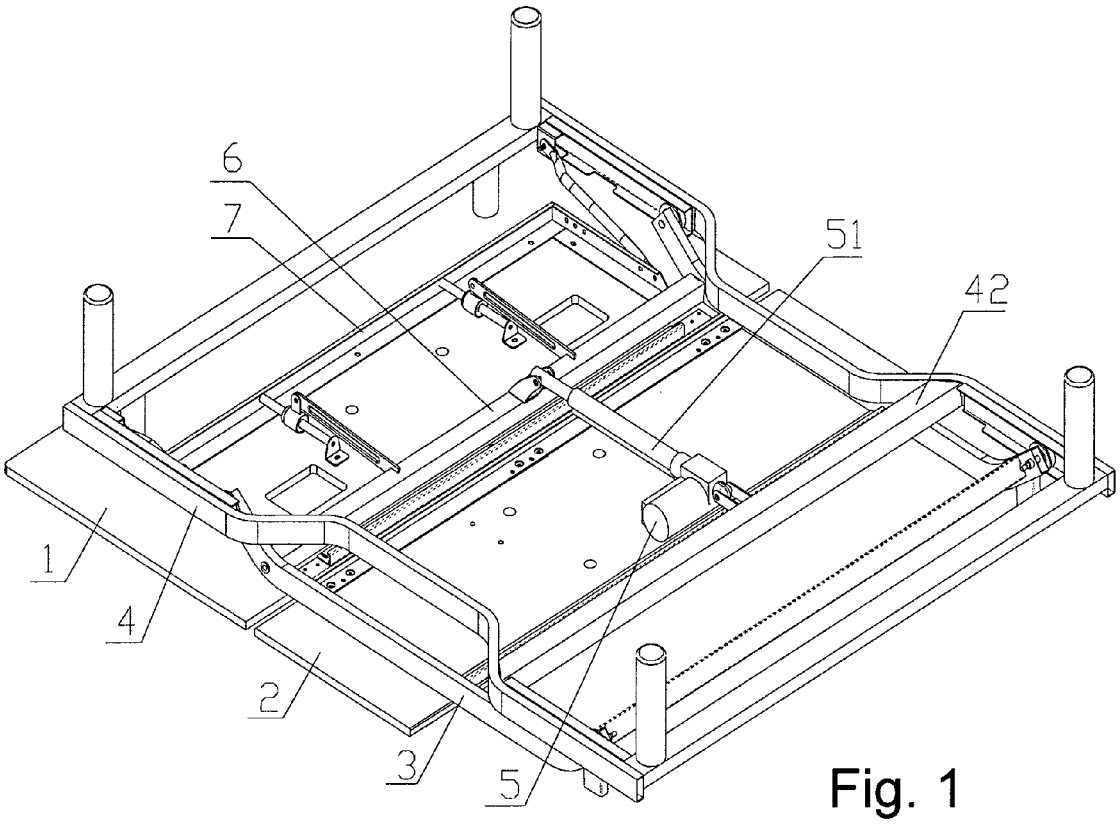
FIG. 1 is a bottom perspective view schematic structural diagram of the front motor driven electric bed.
Figure 2:
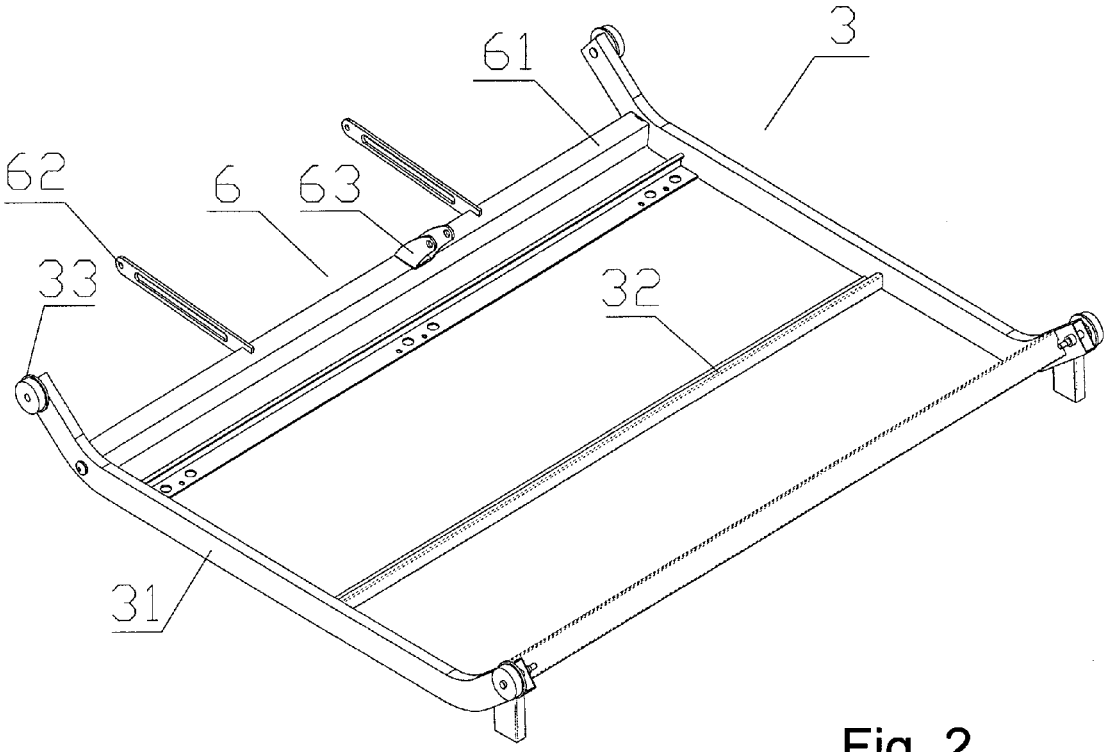
FIG. 2 is a bottom perspective view of the drive structure on the frame and the motor bracket front connection diagram.
Figure 3:
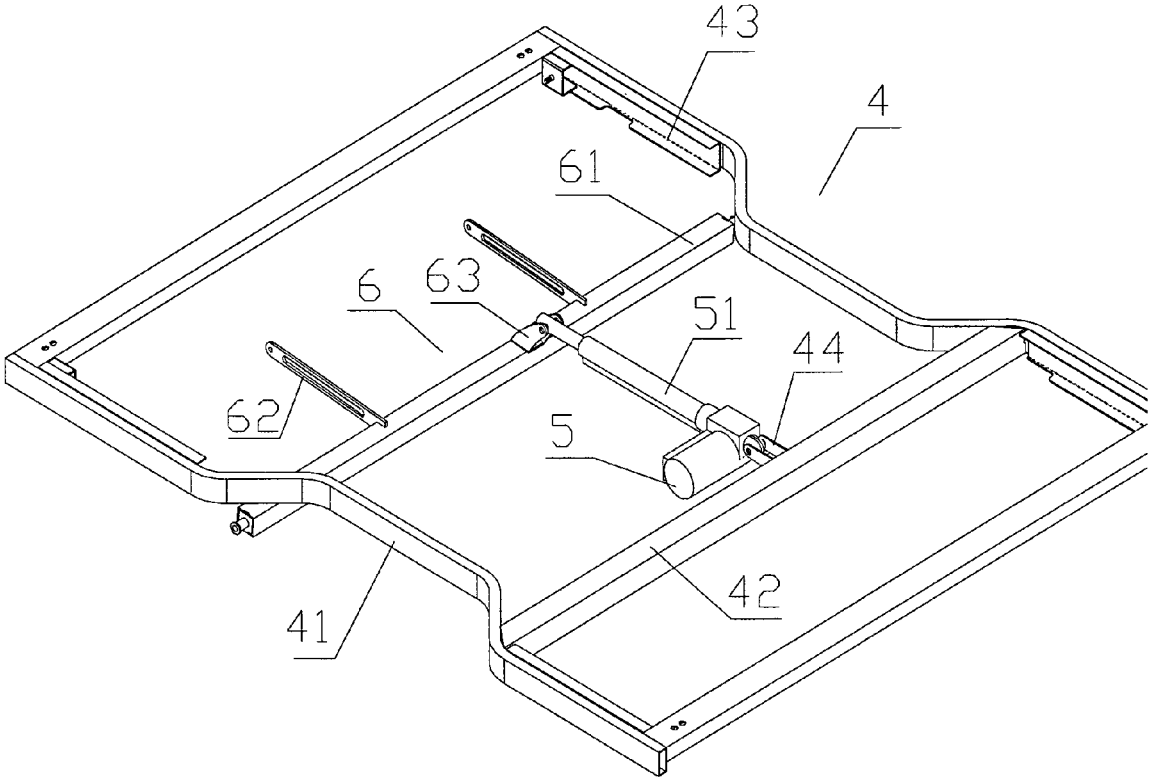
FIG. 3 is a bottom perspective view of the motor drive structure and the lower frame and the motor bracket front connection diagram.

The following call out list of elements can be a useful guide in referencing the element numbers of the drawings.

1 Headback Bedboard
2 Middle Bedboard
3 Upper Frame
31 Two Side Bars
32 Horizontal Rods
33 Four Guiding Mechanism
4 Lower Frame
41 Rectangular Frame
42 Intermediate Connecting Rod
43 Four Short Guide Rail
44 First Bracket
5 Front Motor
51 Drive Rod
6 Front Motor Frame
61 Rotating Lever
62 Two Connecting Rods
63 Second Bracket
7 Linear Bearing Assembly
71 Bottom Edge Member
72 Two Side Edge Members
73 Two Linear Bearings
74 Two Bottom Base Stands

DESCRIPTION OF THE PREFERRED EMBODIMENTS

As shown in FIGS. 1 to 4, the front motor driving structure of the present invention electric bed comprises: a middle bedboard 2 that is fixed to the upper frame and hinged to a headback bedboard 1; a front motor 5; an upper frame 3, a lower frame 4, and a drive rod 51 of the front motor 5. The user sits on the middle fixed bedboard 2 and in the middle fixed bed board 2 can be called a seat board. The user head and back are supported by the headback bedboard 1.

The upper frame 3 comprises two side bars 31, two horizontal bars 32 and four guiding mechanism 33. The two side bars 31 are arranged parallel at an interval with two ends bent down. The two horizontal bars 32 are parallel with each other and also set in between two sidebars 31. As described, four guide mechanisms 33 are between two sides of the two sidebars 33. Two horizontal bars 32 are set in the bottom of the fixed bed board 2. The above upper frame 3 has one end extending to the head back portion 1 bottom. The lower frame 4 includes a rectangular frame 41, the intermediate connecting rod 42, and the first bracket 44 and four short rails 43. The intermediate connecting rod 42 is set inside the rectangular frame 41. The first bracket 44 is set above the intermediate connecting rod 42. The four short rails 43 are set inside two sides of the rectangular frame 41. The upper frame 3 has four guide mechanisms 33 located within the four short rails 43 of the lower frame 4. The drive structure further comprises a front motor bracket 6 and the linear bearing assembly 7.

The motor bracket 6 includes a rotating lever 61, and two connecting rods 62 and 63 of the second bracket. Rotation of the horizontal lever 61 is hinged to the upper frame 3 at one end of the two sides of the lever 31 between the two connecting rods 62 vertically spaced and disposed on the rotating lever 61. The second bracket 63 is provided in the bottom surface of the rotating lever 61.

Figure 4:
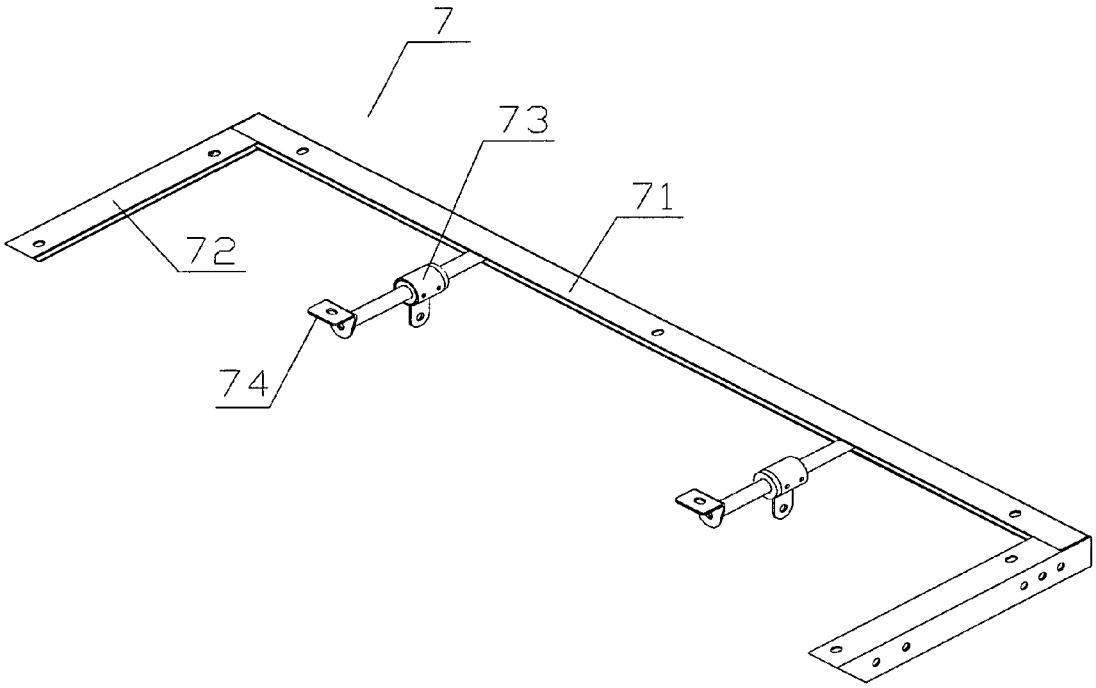
FIG. 4 is a top perspective view of a schematic structural diagram of the linear bearing assembly drive structure.

The linear bearing assembly 7, FIG. 4 includes a bottom edge member 71, two side edge members 72, two linear bearings 73 and two base members 74. The two side edges 72 are separately situated upon two sides of the bottom edge 71. The two linear bearings 73 have one end spaced vertically from the bottom edge 71. The two base stands 74 are located at the other end of the two linear bearings 73. The bottom edge 71, two sides of the bottom edge of the base 72 and two bases 74 are located at the back of the head bottom surface of the headback bedboard 1. During installation, it is preferred that the bottom surface of the headback bedboard 1 has a smooth plywood surface that can receive wood screws that pass through screw openings formed on the bottom edge member 71 and the two side edge members 72. The bottom edge member 71 can be riveted or welded to the two side members 72. The base stand 72 is also preferably screwed to the bottom surface of the headback bedboard 1. The linear bearings 73 may have a flange with an opening for receiving hinge connection with the ends of the two connecting rods 62. The flange of the linear bearings are oriented downward. The linear bearings are mounted on linear bearing rails that preferably have a round cross-section. The linear bearing rails are bridged between the two base stands 74 and the bottom edge 71. The linear bearing rails can be attached to a vertical portion of the two base stands 74 and to a vertical portion of the bottom edge 71. The bottom edge member and two side edge members can be made of angle iron such as slotted angle iron.

The front motor bracket 6 is a metal frame including two connecting rods 62 welded to rotating lever 61 which is welded to the second bracket 63. The front motor bracket 6 has two connecting rods 62 hinged to the two linear bearings 73 at the upper tips of the two connecting rods 62. The front motor 5 and the lower frame 4, are hinged at the intermediate connecting rod 42 on the first bracket 44. The front motor 5 drive rod 51 are hinged to the top of the front motor bracket 6 rotating lever 61 on the second bracket 63.

The front motor bracket 6 is welded to second bracket 63 which is a curved bracket that is curved toward the front motor 5 direction. The curved bracket is set so that the front motor driving the rotating lever has a longer lever arm during rotation, so will be able to produce greater torque motor with smaller power, so that the front motor is sufficient to drive the rotating lever rotation.

On the upper frame 3, the four guide mechanism 33 can be guide wheels or guide sliders. Various guide mechanisms can provide good guiding whether they be guide wheels as shown or guide sliders on the lower frame rails as long as they make the upper frame and the lower frame active connections more reliable.

The upper frame 3 two crossbars 32 are secured by means of screws located at the fixed bedboard bottom surface. The bottom edge 71 of the linear bearing assembly 7, the two side edges 72 and the base 74 are connected by screws, respectively provided in a bottom surface of the head back bedboard. The front motor rotating lever 61 has a sectional view of the bracket 6 that is rectangular. A rectangular cross-section of the rotating lever is preferred for a good rigidity and improving torsional properties of the rotating lever to avoid the deformation or distortion of the rotating lever.

The lower frame 4 rectangular frame 41 has a middle narrow portion and the intermediate connecting rod 42 is provided on a rectangular frame 41 and the inner side of the narrow portion. The rectangular frame 41 preferably has a middle narrow portion that can have an hourglass shape to provide for an indent near a person's foot when a person is trying to get on the bed and off the bed. As the lower frame for the entire electric bed support frame has a rectangular middle narrow portion, this preferably improves the rigidity of the lower frame to secure the stability of the electric bed support while also improving the appearance of the electric bed.

Compared to traditional electric beds, the best mode is to use high quality linear bearings that could allow for a smaller front motor. This design strategy drive structure aims to be more reasonably optimized for improving structural stability of each frame member. The present invention can be a convenient retrofit for conserving production costs and materials, with reliable performance and convenient installation and maintenance. This design trade-off seeks to further improve the overall performance of the electric bed while effectively reducing the weight of the entire bed. Gearing the loading movement of the electric bed head backboard the front motor preferably takes on a more evenly distributed force. Each frame is also not easily deformed as a user shifts weight from a left to right side of the bed. The backboard connection with each framework has a more reliable connection and is more secure. Having the front motor bracket 6 second bracket 63 connected to a metal connection rod 62 allows force to be more evenly distributed since it avoids a direct connection between the metal second bracket and the plywood headback bedboard.

The front motor fixed points are located at the middle of the lower frame through its first bracket. The front motor drive shaft connects the front motor rotating lever through the second bracket. When the front motor starts to drive, the driving rod pushes the second bracket which rotates the rotating rod through the hinge point of the upper frame. Meanwhile, the front motor support has two rods which drive the two linear bearings of the linear bearing assembly. Through the linear bearing assembly connecting to the bottom edge of the head bed board, two side rods and the two bases then land the head backboard to rotate at the connection point with the fixed bed board. This also achieves the rotational rising of the head backboard. When needing to decline the head backboard to prone position, the front motor can be rotated in reverse. The drive rod can also pull the rotary rod in reverse rotation so that the headback bedboard rotation decline is controlled by a linear bearing assembly.

Design parameters for super obese users should have the drive mechanism structure overcome the stress concentration defects of the traditional front motor drive structure. The front motor connecting to the rotation of the front motor bracket lever should provide a certain amount of torque to move the linear bearing assembly during rotation while also lifting the headback bedboard, and improving the motor load conditions to preserve the life of the front motor, and also make the headback bedboard have smoother movement in an non jamming manner. The linear bearing assembly of the headback bedboard should more smoothly lift the underside of the headback bedboard to smooth out the push and pull forces on headback bedboard and thus avoid the traditional structure of the front motor drive rod pushing on the headback bedboard where the bedboard could be easy to damage.

The invention claimed is:

1. An electric bed front motor drive structure comprising:

a. head back bedboard in hinged connection to a middle bedboard, wherein the middle bedboard is attached to and supported by an upper frame, wherein the upper frame is attached to and supported by a lower frame, wherein the head back bedboard is configured to hinge upward for raising a head of a user;

b. wherein the lower frame has a pair of connecting rods extending toward the head back bedboard;

c. a linear bearing assembly having edge members attached to linear bearings, wherein the linear bearing assembly is attached to the head back bedboard to support the head back bedboard, wherein the linear bearing assembly is hinged to the pair of connecting rods in a sliding configuration;

d. a front motor mounted to the lower frame at a first end of the front motor, and hinge mounted to a front motor frame at a second end of the front motor, wherein the front motor is configured to push up the head back bedboard when the front motor has a drive rod that extends to travel from a retracted position to an extended position, wherein during front motor operation, the head back bedboard has supplemental support from the pair of connecting rods, wherein the linear bearings assemblies are mounted under the head back bedboard and are actuated by the front motor so that they slide when raising and lowering the head back bedboard.

2. The electric bed front motor drive structure of claim 1, wherein the upper frame further comprises two sidebars that have horizontal rods to support the two sidebars, wherein the two sidebars terminate at guiding mechanism, wherein a total of four diving mechanisms are provided on ends of the two sidebars.

3. The electric bed front motor drive structure of claim 1, wherein the lower frame includes a rectangular frame formed as a periphery of the lower frame, wherein the rectangular frame has an intermediate connecting rod extending horizontally across the rectangular frame, wherein the rectangular frame further includes four short guide rails mounted horizontally on the rectangular frame, wherein the rectangular frame further includes a first bracket for mounting to the front motor first end.

4. The electric bed front motor drive structure of claim 1, wherein the front motor frame further includes a second bracket receiving the second end of the front motor, wherein the front motor frame further includes a second bracket mounted to a rotating lever that is swivel mounted to the front motor frame.

5. The electric bed front motor drive structure of claim 4, wherein the two connecting rods are welded to the rotating lever.

6. The electric bed front motor drive structure of claim 1, wherein the edge member attached to linear bearings further comprise a bottom edge member having a bottom edge member fist end and a bottom edge member second end; and wherein the edge member attached to linear bearings further comprise two side edge members, namely a first edge side member and a second edge side member, wherein the first edge side member is connected to the bottom edge member first end and, wherein the second edge side member is connected to the bottom edge member second end.

7. The electric bed front motor drive structure of claim 1, further comprising two bottom base stands formed on the linear bearing assembly to support the linear bearings.

8. The electric bed front motor drive structure of claim 7, wherein the upper frame further comprises two sidebars that have horizontal rods to support the two sidebars, wherein the two sidebars terminate at guiding mechanisms, wherein a total of four diving mechanisms are provided on ends of the two sidebars.

9. The electric bed front motor drive structure of claim 7, wherein the lower frame includes a rectangular frame formed as a periphery of the lower frame, wherein the rectangular frame has an intermediate connecting rod extending horizontally across the rectangular frame, wherein the rectangular frame further includes four short guide rails mounted horizontally on the rectangular frame, wherein the rectangular frame further includes a first bracket for mounting to the front motor first end.

10. The electric bed front motor drive structure of claim 7, wherein the front motor frame further includes a second bracket receiving the second end of the front motor, wherein the front motor frame further includes a second bracket mounted to a rotating lever that is swivel mounted to the front motor frame.

11. The electric bed front motor drive structure of claim 10, wherein the two connecting rods are welded to the rotating lever.

12. The electric bed front motor drive structure of claim 7, wherein the edge member attached to linear bearings further comprise a bottom edge member having a bottom edge member first end and a bottom edge member second end; and wherein the edge member attached to linear bearings further comprise two side edge members, namely a first edge side member and a second edge side member, wherein the first edge side member is connected to the bottom edge member first end and, wherein the second edge side member is connected to the bottom edge member second end.

* * * * *